United States Patent [19]

Lessnig et al.

[11] 4,096,965

[45] Jun. 27, 1978

[54] STORAGE DEVICE FOR SAMPLE CONTAINERS

[75] Inventors: Werner Lessnig; Günter Metz, both of Cologne; Willi Spiegel; Jürgen Fleischer, both of Leverkusen, all of Germany

[73] Assignee: Bayer Aktiengesellschaft, Leverkusen, Germany

[21] Appl. No.: 724,199

[22] Filed: Sep. 17, 1976

[30] Foreign Application Priority Data

Oct. 4, 1975 Germany ..... 2544533

[51] Int. Cl.[2] ..... A47B 73/00; B65D 53/00

[52] U.S. Cl. ..... 220/20; 73/423 A; 206/522; 206/523; 206/526; 211/76; 217/35; 220/232; 220/378; 312/209

[58] Field of Search ..... 206/522, 523, 334, 427, 206/521, 525–527, 583, 591, 592, 588, 589, 590; 277/34, 34.3; 217/35, 52, 34; 220/240, 232, 255, 378, 20; 73/423 A; 211/82, 83, 84, 76; 221/87, 151, 247; 312/209, 35

[56] References Cited

U.S. PATENT DOCUMENTS

| | | | |
|---|---|---|---|
| 91,884 | 6/1869 | Thompson | 217/35 |
| 254,838 | 3/1882 | Peacock | 206/427 |
| 442,971 | 12/1890 | Glass | 217/52 |
| 837,224 | 11/1906 | Holcomb | 312/209 |
| 1,153,185 | 9/1915 | Allen | 217/35 |
| 1,293,788 | 2/1919 | Jaklich | 211/83 |
| 2,018,005 | 10/1935 | Barnby | 206/427 |
| 2,157,983 | 5/1939 | Glougie | 220/240 |
| 2,681,142 | 6/1954 | Cohen | 206/583 |
| 2,764,950 | 10/1956 | Finnell | 206/522 |
| 2,833,398 | 5/1958 | Marshall | 206/522 |
| 2,888,717 | 6/1959 | Domitrovic | 220/232 |
| 3,002,828 | 10/1961 | Fino et al. | 220/225 |
| 3,072,022 | 1/1963 | Wood et al. | 206/522 |
| 3,098,721 | 7/1963 | Jewell | 220/255 |
| 3,231,454 | 1/1966 | Williams | 217/52 |
| 3,366,231 | 1/1968 | Trakas | 206/522 |
| 3,421,679 | 1/1969 | Goldman | 217/34 |
| 3,527,101 | 9/1970 | Sprunger et al. | 73/423 A |
| 3,630,088 | 12/1971 | Sawyer et al. | 73/423 A |
| 3,949,876 | 4/1976 | Bridges et al. | 220/9 F |
| 4,037,722 | 7/1977 | Bremer | 206/523 |

FOREIGN PATENT DOCUMENTS

| | | | |
|---|---|---|---|
| 2,218,759 | 10/1973 | Germany | 206/522 |

*Primary Examiner*—William Price
*Assistant Examiner*—Allan N. Shoap
*Attorney, Agent, or Firm*—Burgess, Dinklage & Sprung

[57] ABSTRACT

A device for the storage of sample containers comprises a holder for receiving the sample containers and a covering, whereby a common covering is provided for all the sample containers which seals them individually and simultaneously.

1 Claim, 5 Drawing Figures

STORAGE DEVICE FOR SAMPLE CONTAINERS

The invention relates to a storage device for sample containers which comprises a holder for receiving the sample containers and a cover.

Storage devices of this type work preferably together with automated measurement devices. In the case of operation monitoring of series tests in the laboratory they store certain fractions in individual sample containers from which the quantities required for analyses in gas chromatographs, mass spectrometers or other measurement devices are then removed. Such storage devices are also known in the reverse working method, for collecting samples (fraction collector).

Known storage devices for sample containers are open, i.e. the sample containers are not covered and frequently solvent evaporation becomes disruptive since the residence time in the storage device can vary within wide limits. To avoid this source of error, devices are known in which all the sample containers are covered by a cowl and the space above the samples is filled with inert gas. Occasionally the sample containers are also covered individually, for example with covering sheets or inert liquids. The first method does not completely exclude solvent evaporation if the samples spend times of varying lengths in the storage device. In the case of the individual covering of each sample, the work and cost involved is considerable and the great danger of sample pollution is disadvantageous.

The object of the invention is to prevent solvent evaporation in a device for the storage of sample containers, so that the concentration of the samples remains unchanged over periods of hours and days and to provide a technically simple embodiment of the storage device which can be adapted well to the operation cycle.

According to the invention, there is provided a device for the storage of sample containers comprising a holder having a plurality of cavities therein for receiving the sample containers and a common covering for all the sample containers for sealing them individually and simultaneously.

It has proved to be a particular advantage of the embodiments of the device according to the invention described below that they are simple to produce in terms of design and safe in operation and that by the constant covering of all samples which is only interrupted during filling and removal, an alteration of the sample concentration by solvent evaporation is substantially avoided, irrespective of whether the samples are further processed at short time intervals or whether for example samples are stored over the week-end.

According to a first embodiment, the covering for the sample containers comprises an elastic inflatable membrane or alternatively of an inflatable bellows which are preferably produced from solvent resistant material. Upon inflation, the membrane or bellows is laid over the openings of the sample containers and seals them simultaneously. Even slight differences of height or unevennesses at the edge of the sample containers are compensated by the elasticity of the coverings.

For the automatic transport of the sample containers, as is necessary for example in the case of sample collectors and sample dispensers, in this arrangement it is sufficient to evacuate the membrane chamber or bellows for a short time in order to release the saple containers and permit contactless transport. The pollution of the sample by rubbing on the sealing material is thereby prevented.

In a further embodiment of the device according to the invention, a sealing plate on the under side of the lowerable covering and pressure springs beneath the sample containers are present. It will be understood that a device is similar in which the covering is rigid but the holder with the sample container can be lifted.

In a further embodiment of the device according to the invention, the rigid covering is provided with a sealing plate, and the sample containers can be pressed against the sealing plate. This takes place for example by means of inflatable bellows or by means of compressed air cushions under the sample containers.

All the sample containers are always sealed precisely and simultaneously and the control of the covering is so simple that the integration of the storage device in an automated analysis system presents no problems.

Figure 1:
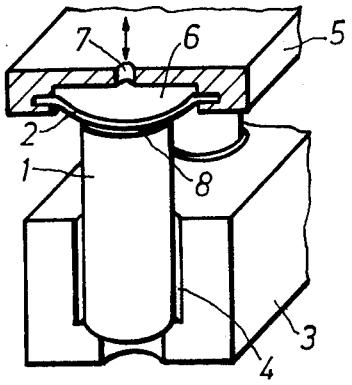
FIG. 1 shows the sealing of sample containers with a membrane in the covering.

According to FIG. 1, the sealing of the sample containers 1 takes place by means of an elastic inflatable membrane 2 of solvent resistant material. The holder 3 contains holes 4 to receive the sample containers 1. The sample containers 1 project from the block 3. The distance between the holder 3 and the sealing membrane 2 is permanently adjusted. The sealing membrane 2 is inserted in airtight manner in the covering plate 5. Above the sealing membrane 2 there is located a cavity 6 in the covering plate 5. This cavity 6 is supplied via a connection 7 either with compressed air or vacuum. When pressure is supplied, the membrane 2 curves outwards and seals the openings 8 of the sample containers 1. Unevennesses in the edges of the sample containers 1 are filled by the flexible membrane 2. For the transport of the sample containers 1, the cavity 6 is evacuated. The membrane 2 then retracts into the cavity 6 and releases the sample containers 1 for transport.

Figure 2:
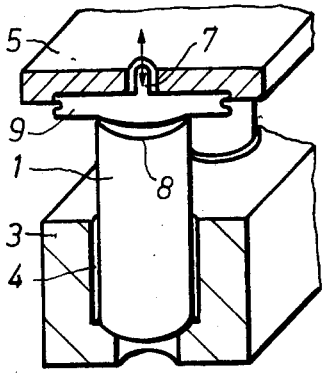
FIG. 2 shows the sealing of sample containers with a bellows on the covering.

In the embodiment according to FIG. 2, a bellows 9 of solvent resistant material replaces the membrane 2 of FIG. 1. The bellows 9 permits a greater lift distance.

This advantageous method of sealing can be used both in the case of sealing with a membrane and with a bellows but not only when the sample containers are arranged consecutively in linear fashion but also in the case of the distribution of the holes in the holder over an area.

Figure 3:
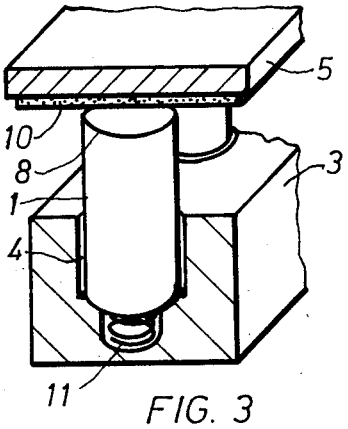
FIG. 3 shows the sealing with a lowerable sealing plate.

According to FIG. 3 the central sealing is effected by the sample containers 1 being pressed against a seal 10 arranged beneath the fixed covering plate 5. For this purpose, pressure springs 11 are provided on the bottom of the holes 4. For the contact-less transport of the sample containers 1, the holder 3 is lowered or the covering plate 5 is raised with known mechanical means. Differences in length of the sample containers 1 are compensated by the springs 11 and the sealing pressure is adjusted via the spring force of the springs 11.

Figure 4:
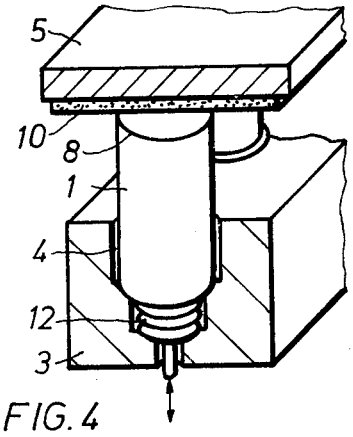
FIG. 4 shows the sealing with a sealing plate and a bellows underneath the sample container.

According to FIG. 4, a bellows 12 is provided under each sample container 1. When supplied with compressed air, the sample containers 1 are pressed upwardly against the fixed seal 10 underneath the covering plate 5 and thus simultaneously sealed. The bellows 12 are evacuated for the transport of the sample containers 1.

Figure 5:
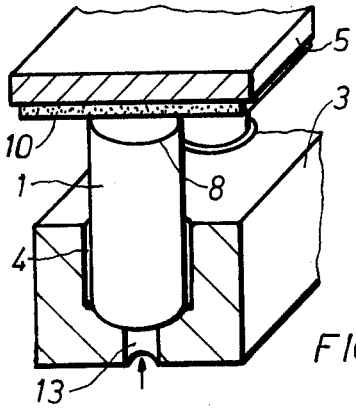
FIG. 5 shows the sealing with a sealing plate and an air cushion under the sample container.

According to FIG. 5, the sample container and the hole 4 work together as a piston and cylinder. When pressure is supplied via the bores 13, the sample containers 1 are pressed against the fixed covering plate 5 and thus sealed. For the transport of the sample containers 1, the air supply is cut off.

What we claim is:

1. A device for the storage of sample containers comprising: a holder having a plurality of cavities therein, each cavity receptive of a sample container having a portion projecting outwardly therefrom; a common cover for all of the received sample containers and positionable over the holder and on the projecting portions of the containers to float thereon unsupported by the holder; and means coactive with said cover when disposed in position over the holder and unsupported thereby for individually sealing each sample container simultaneously, wherein the means for sealing comprises a cavity in the cover, an elastic inflatable membrane disposed on the underside of the cover in the cavity deformable outwardly into sealing engagement with the received sample containers and retractable into the cavity to release the sealing engagement.

* * * * *